United States Patent [19]

Abendroth et al.

[11] Patent Number: 4,910,936

[45] Date of Patent: Mar. 27, 1990

[54] FLOORING SYSTEM

[75] Inventors: Carl W. Abendroth; Gary Stephenson, both of Crystal Falls, Mich.

[73] Assignee: AGA Corporation, Amasa, Mich.

[21] Appl. No.: 296,872

[22] Filed: Jan. 12, 1989

Related U.S. Application Data

[63] Continuation of Ser. No. 197,277, May 23, 1988, abandoned, which is a continuation of Ser. No. 24,583, May 20, 1987, Pat. No. 4,749,164, which is a continuation-in-part of Ser. No. 855,958, Apr. 25, 1986, abandoned, which is a continuation-in-part of Ser. No. 608,389, May 9, 1984, Pat. No. 4,589,243, which is a continuation-in-part of Ser. No. 387,184, Jun. 10, 1982, Pat. No. 4,449,342.

[51] Int. Cl.[4] ..... E04B 1/62

[52] U.S. Cl. ..... 52/403; 52/408; 52/480

[58] Field of Search ..... 0/0

[56] References Cited

U.S. PATENT DOCUMENTS

| | | | |
|---|---|---|---|
| 2,112,480 | 3/1938 | Coddington | 52/376 |
| 3,271,916 | 9/1966 | Omholt | 52/480 X |
| 3,518,800 | 7/1970 | Tank | 52/480 X |
| 3,566,569 | 3/1971 | Coke et al. | 52/480 X |
| 3,596,422 | 8/1971 | Boettcher | 52/480 X |
| 3,828,503 | 8/1974 | Hofmann | 52/393 |
| 4,530,193 | 7/1985 | Ochs | 52/408 |
| 4,589,243 | 5/1986 | Abendroth et al. | 52/403 |
| 4,759,164 | 7/1988 | Abendroth et al. | 52/403 |

*Primary Examiner*—Carl D. Friedman

*Attorney, Agent, or Firm*—Michael, Best & Friedrich

[57] ABSTRACT

Disclosed herein is a flooring system comprising a foundation, a resilient layer overlying the foundation, a layer of resilient material overlying the resilient layer, a layer of rigid material including a channel overlying the layer of resilient material, an elongate laminated member disposed within the channel and secured to the layer of rigid material, a floorboard overlying the layer of rigid material and the laminated member, a fastener extending through the floorboard and into the laminated member to secure the floorboard to the layer of rigid material, and structure formed in the resilient layer for venting water vapor accumulating between the resilient layer and the foundation.

9 Claims, 2 Drawing Sheets

FLOORING SYSTEM

RELATED APPLICATION

This application is a continuation of application Ser. No. 197,277, filed May 23, 1988, now abandoned, which application, in turn, is a continuation of application Ser. No. 024,583, filed May 20, 1987, now U.S. Pat. No. 4,749,164, granted July 26, 1988, which application is a continuation-in-part of U.S. Abendroth application Ser. No. 855,958, filed Apr. 25, 1986, now abandoned, which, in turn, is a continuation-in-part of co-pending U.S. Abendroth application Ser. No. 608,389, filed May 9, 1984, now U.S. Pat. No. 4,589,243 granted May 20, 1986, which, in turn, is a continuation-in-part of U.S. Abendroth application Ser. No. 387,184, filed June 10, 1982 and issued May 22, 1984, as U.S. Pat. No. 4,449,342.

BACKGROUND OF THE INVENTION

This invention relates generally to flooring systems and, in particular, to flooring systems providing uniform resiliency and shock absorbency.

Various known flooring systems include laminated steel and wood strips or "nailers" for securely anchoring the ends of a plurality of flooring nails. Although it is known to install such strips over a resilient underlayment, in prior flooring systems, the laminated strips have been secured by means of fasteners driven through the underlayment directly into a concrete substrate or foundation. This results in nonuniform floor resilience and the possibility of looseness in the event the attachment to the concrete foundation fails.

Attention is directed to U. S. Pat. No. 3,473,281, issued Oct. 21, 1969 to Omholt, which discloses a flooring system having elements of desired tensile and shear strength for preventing wooden support growth transverse to a plurality of floorboards.

SUMMARY OF THE INVENTION

This invention provides a flooring system comprising a layer of rigid material overlying a foundation and including a channel, an elongate laminated member within the channel and secured to the layer of rigid material, a floorboard overlying the layer of rigid material and the laminated member, and a fastener extending through the floorboard and into the laminated member for securing the floorboard to the layer of rigid material.

The invention also provides a flooring system comprising a foundation, a layer of resilient material overlying the foundation, a layer of rigid material overlying the layer of resilient material and including an upper surface and an elongate channel formed in the upper surface, a first metallic layer disposed within the elongate channel, a layer of wood-product material disposed within the channel over the first metallic layer, a second metallic layer disposed within the channel over the wood-product layer, a fastener extending through the layer of rigid material and through the first metallic layer, the second metallic layer, and the wood product layer, for securing the first metallic layer, the second metallic layer and the wood-product layer within the channel and to the layer of rigid material, a floorboard disposed over the upper surface and the second metallic layer, and a fastener extending through the floorboard and the second metallic layer into the wood-product layer for securing the floorboard to the layer of rigid material.

The invention also provides a flooring system comprising a foundation, a layer of resilient foam overlying the foundation, a layer of wood-product material overlying the resilient foam and including an upper surface and an elongate channel formed in the upper surface, a first elongate steel strip disposed within the channel, an elongate wood-product strip disposed within the channel over the first steel strip, a second steel strip disposed within the channel over the wood-product strip, a first fastener extending through the wood-product layer, the first steel strip, the wood product strip and the second steel strip for securing first steel strip, the wood product strip and the second steel strip within the channel and to the wood-product layer, a floorboard disposed over the upper surface of the wood-product layer and over the channel, and a second fastener driven through the floorboard and the second steel strip into the wood-product strip.

The invention also provides a flooring system comprising a foundation, a resilient layer overlying the foundation, a layer of rigid material overlying the resilient layer and including a channel, an elongate laminated member disposed within the channel and secured to the layer of rigid material, a floorboard overlying the layer of rigid material and the laminated member, a fastener extending through the floorboard and into the laminated member for securing the floorboard to the layer of rigid material, and means formed in the resilient layer for venting water vapor accumulating between the resilient layer and the foundation.

In one embodiment, the laminated member comprises a lower elongate metallic strip, an elongate wood-product strip disposed over the lower metallic strip, and an elongate upper metallic strip disposed over the wood-product strip.

In one embodiment, the layer of rigid material includes an upper surface having formed therein the channel and the upper metallic strip is substantially coplanar with the upper surface when the laminated member is secured within the channel.

In one embodiment, the thickness of the lower metallic strip is substantially greater than the thickness of the upper metallic strip, and the thickness of the wood-product strip is substantially greater than the thickness of the lower metallic strip.

In one embodiment, the layer of rigid material includes a plurality of channels, and a plurality of elongate laminated members are secured within respective ones of the channels.

In one embodiment, the elongate laminated members are oriented so as to be substantially parallel to each other and substantially perpendicular to the floorboard.

In one embodiment, the layer of rigid material comprises a plurality of individual sheets in substantially coplanar alignment with respect to one another.

In one embodiment, the layer of resilient material comprises flexible polyethylene foam.

One of the principal features of the invention is the provision of flooring system which includes a laminated, fastener-securing anchor in combination with a uniformly resilient underlayer.

Another of the principal features of the invention is the provision of a laminated, fastener-securing anchor secured to a rigid layer, which rigid layer free-floats over the resilient underlayer.

Another of the principal features of the invention is the provision of flooring system which includes a laminated, fastener-securing anchor in combination with a uniformly resilient underlayer and means for avoiding the accumulation of water between the flooring system and an underlying foundation.

Another of the principal features of the invention is the provision of a laminated, fastener-securing anchor secured to a rigid layer, which rigid layer free-floats over a resilient underlayer having therein formed a plurality of channels for venting moisture from between the resilient underlayer and an underlying foundation.

Other features and advantages of the invention will become apparent upon review of the following detailed description, drawings, and claims.

Figure 1:
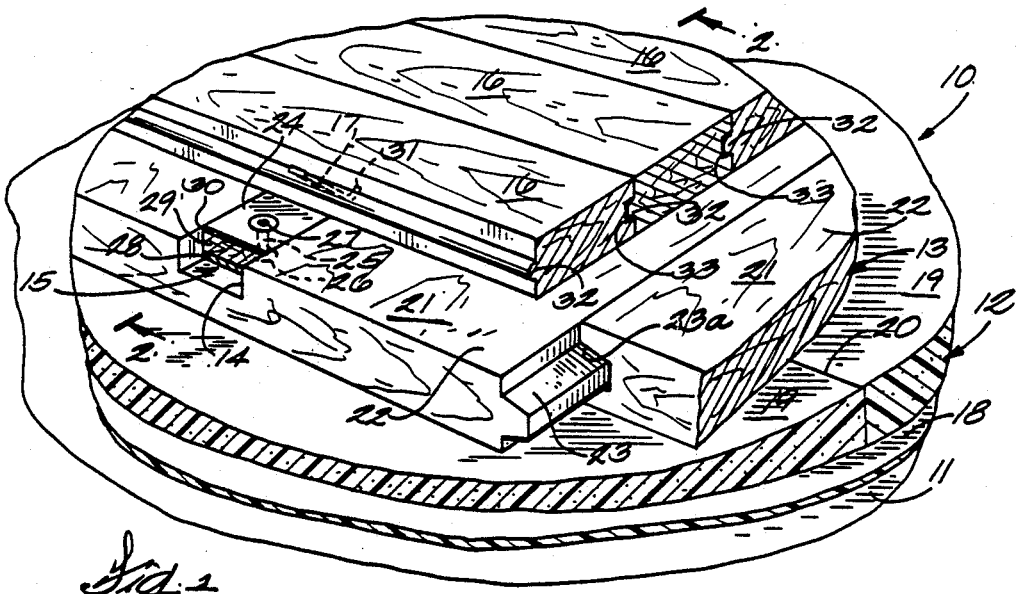
FIG. 1 is a partial perspective view of a portion of a flooring system which includes a free-floating rigid layer disposed over a resilient underlayer.

Before one embodiment of the invention is described in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Referring to the drawings, and in particular to FIG. 1, a flooring system 10 is shown. As illustrated, flooring system 10 includes a sub-floor foundation or slab 11, a layer of resilient material 12 overlying foundation 11, a layer of rigid material 13 overlying the resilient layer 12 and including, in the upper surface thereof, at least one and preferably a plurality of channels 14, at least one and preferably a plurality of elongate laminated members 15 secured within respective ones of the channels 14, a plurality of floorboards 16 overlying the rigid layer 13, and a plurality of fasteners 17 extending through the floorboards 16 and into the laminated members 15 for securing the floorboards to the rigid layer 13.

The foundation 11 comprises a concrete sub-floor which has been finished and leveled. To prevent the migration of moisture between the foundation 11 and the resilient layer 12, a vapor barrier 18 is preferably disposed over foundation 11 and under resilient layer 12. Preferably, vapor barrier 18 is formed of six mil polyethylene with four inch lap joints covered with a felt membrane. It will be appreciated that other materials, such as two-ply asphalt-saturated felt set in mastic, can also be used.

To provide the flooring system 10 with uniform resiliency and shock absorbing qualities, resilient layer 12 is preferably formed of 5/8 inch thick, flexible closed-cell expanded polyethylene foam, although different thicknesses and materials can be used. Preferably, the resilient layer 12 is formed of a plurality of elongate foam strips 19 arranged in edge-abutting relationship to each other to form therebetween a series of seams 20. Each of the foam strips is positioned over vapor barrier 18 and foundation 11 and is preferably oriented such that the seams 20 between adjacent strips run parallel to the long direction of the area over which flooring system 10 is installed. Preferably, no adhesives or fasteners are provided for securing resilient layer 12 to the vapor barrier 18 or to the foundation 11.

Although different materials of various sizes can be used, rigid layer 13 preferably includes a plurality of elongate, substantially rectangular individual sheets 21 of a wood-product material, such as, for example, one and one-eighth inch thick plywood, arranged in edge-abutting coplanar alignment with one another over the resilient layer 12. It will be appreciated that other wood-product materials, such as, for example, various types of particle-boards, press-boards, chip-boards, and fiber-boards, as well as solid wooden boards, can also be used. Each of the sheets 21 includes a generally horizontal upper surface 22, a generally vertical first edge having an outwardly projecting tongue 23 formed therealong, and a generally vertical second edge having an inwardly extending groove **23*a* formed therealong in which the tongue 23 of an adjacent sheet is received when sheets 21 are arranged in edge-abutting alignment relative to one another. Preferably, the long dimension of each of the sheets 21 is oriented so as to extend substantially perpendicularly to the seams 20 between adjacent ones of the resilient material strips 19. To enhance the uniformity of the resiliency provided by the resilient layer 12, no adhesives or fasteners are used between sheets 21 and the resilient material strips 19. Accordingly, rigid layer 13 "free-floats" over resilient layer 12**.

Channels 14 are each dimensioned to snuggly receive and support the laminated members 15 along three sides. The depth of each channel 14 is such that the top surface 24 of each laminated member 15 lies substantially coplanar with the upper surface 22 of each sheet 21. A means for securing laminated member 15 within channel 14 is provided, and, in the embodiment illustrated, comprises a rivet 25 extending through the laminated member and through sheet 21 at regular spaced intervals along channel 14. Other forms of securing means can also be used. Preferably, a pair of washers 26 and 27 are installed at opposite ends of the rivet 25 in order to more securely retain the laminated member 15 within the channel.

Preferably, the channels 14 and laminated members 15 are spaced at regular intervals from each other and are oriented so as to extend substantially perpendicularly to the length of each floorboard and, as to lie substantially parallel to one another. The spacing between adjacent channels and members is such that a sufficient number of fasteners 17 extends through each floorboard so as to securely lock each floorboard to the underlying rigid layer 13. Each of the laminated members 15 preferably extends across the full width of the area over which the flooring system is to be installed.

To provide a secure anchor for fasteners 17 which preferably comprise flooring nails, the laminated members 15 each include a lower elongate metallic strip 28 of uniform thickness, an elongate wood-product strip 29 of uniform thickness disposed over lower metallic strip 28, and an elongate upper metallic strip 30 of uniform thickness disposed over wood-product strip 29. Preferably, the lower metallic strip 28 is of greater uniform thickness than the upper metallic strip 30. The uniform thickness of the wood-product strip 29 is preferably substantially greater than the thickness of either the lower metallic strip 28 or the upper metallic strip 30. In the embodiment illustrated, the lower metallic strip 28 is formed of 16-gauge steel, the upper metallic strip 30 is formed of 30-gauge steel, and the wood-product strip 29 is formed of ⅜ inch hard maple. It will be appreciated that other suitable materials and dimensions can be used.

Figure 2:
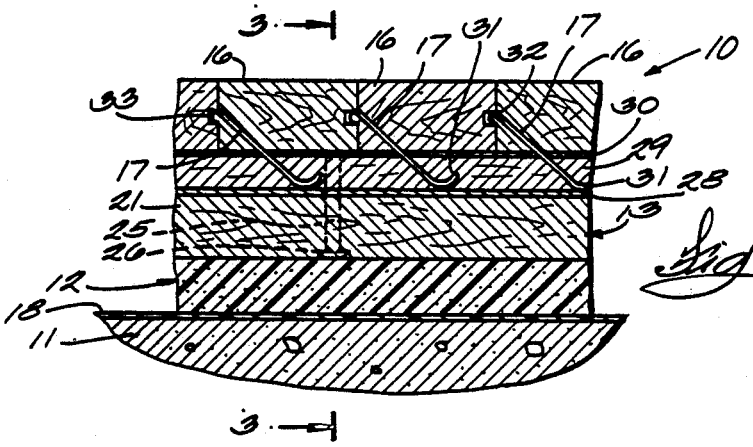
FIG. 2 is a cross-sectional view of the flooring system shown in FIG. 1 taken along line 2—2 thereof.
Figure 3:
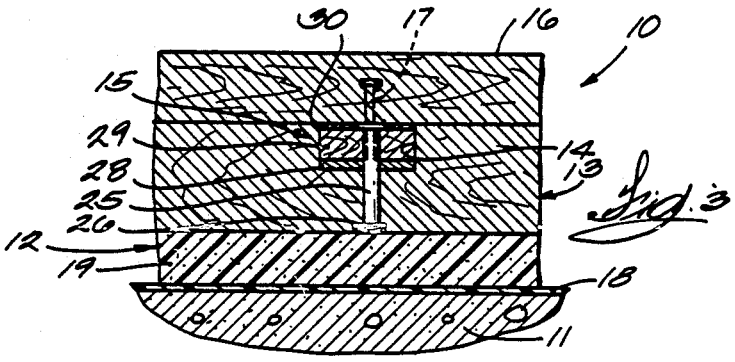
FIG. 3 is a cross-sectional view of the flooring system shown in FIG. 2 taken along line 3—3 thereof.

The fasteners 17 are each located directly over laminated member 15 and are driven through floorboards 16 such that the point 31 of each fastener extends through the upper metallic layer 30 and into the wood-product layer 29. Preferably, the length of each fastener 17 is such that when driven, the point 31 passes through the relatively thin upper metallic layer 30 but is turned up or clinched upon striking the relatively thicker metallic layer 28 as illustrated in FIG. 2. This provides an extremely secure anchor for each of the fasteners 17 and assures that floorboards 16 remain tightly secured to the rigid layer 13.

Although different materials of various sizes can be used, in the illustrated embodiment the floorboards 16 are in the form of 25/32 inch by 2¼ inch hard maple flooring of random lengths. The floorboards 16 are arranged in a plurality of side-by-side, parallel courses extending parallel to the long dimension of the area over which the flooring system is to be installed. A tongue 32, formed along the edge of each floorboard, cooperates with a groove 33 formed in each adjacent floorboard to interlock the adjacent sides of the floorboards to one another.

After all of the courses of floorboards 16 are laid, the flooring system 10 can then be finished by attaching moldings (not shown) to the perimeter of the floorboards to cover any perimeter voids.

Because the laminated members 15 automatically clinch the fasteners 17 as the fasteners are installed, the flooring system 10 provides a floor wherein the individual floorboards 16 are fastened with extreme security to the underlying rigid layer 13. Accordingly, any propensity for the individual fasteners to loosen, and thereby permit the floorboards to buckle or otherwise shift position, is substantially reduced or eliminated. Because rigid layer 13, along with the laminated members 15 and floorboards 16 lie in free-floating relationship over the resilient layer 12, flooring system 10 provides substantially uniform resiliency and shock absorbency without the presence of "dead spots" common to flooring systems wherein a fixed rigid connection to the underlying concrete foundation 11 is made at various locations under the flooring surface.

Figure 4:
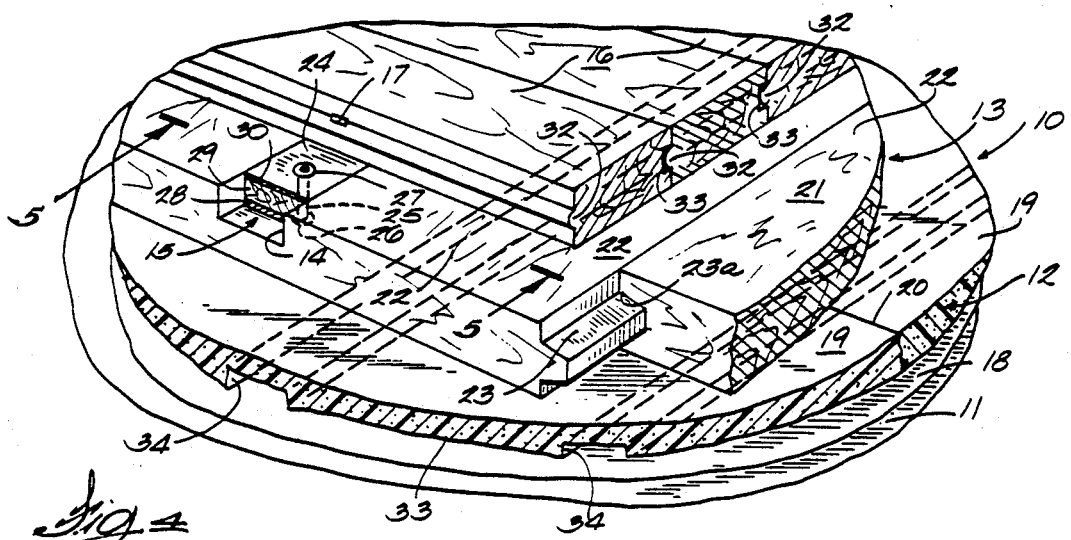
FIG. 4 is a partial perspective view of a portion of an alternative flooring system which embodies various of the features of the invention.
Figure 5:
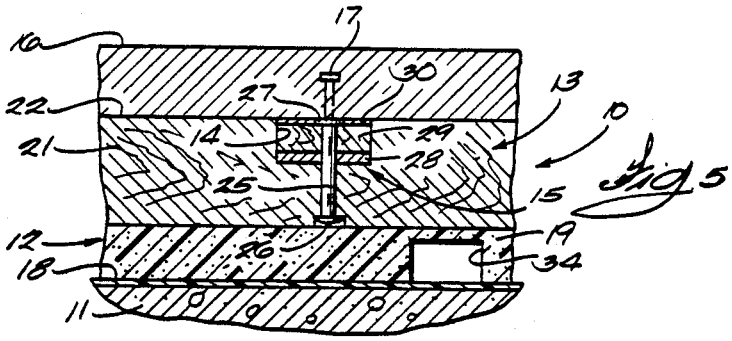
FIG. 5 is a cross-sectional view of the flooring system shown in FIG. 4 taken along line 5—5 thereof.

In the alternative embodiment illustrated in FIG. 4, the resilient layer 12 includes means for venting water vapor accumulating between the resilient layer 12 and the foundation 11. While various suitable venting means can be utilized, in the embodiment illustrated, the resilient layer 12 includes an undersurface 33 adjacent the foundation 11 and the venting means preferably comprises a channel 34 formed in the undersurface 33. Preferably, a plurality of such channels 34 are formed in the resilient layer 12 and, as illustrated, are preferably of substantially rectangular cross-section. Preferably, each of the channels 34 does not extend fully through the resilient layer 12.

Figure 6:
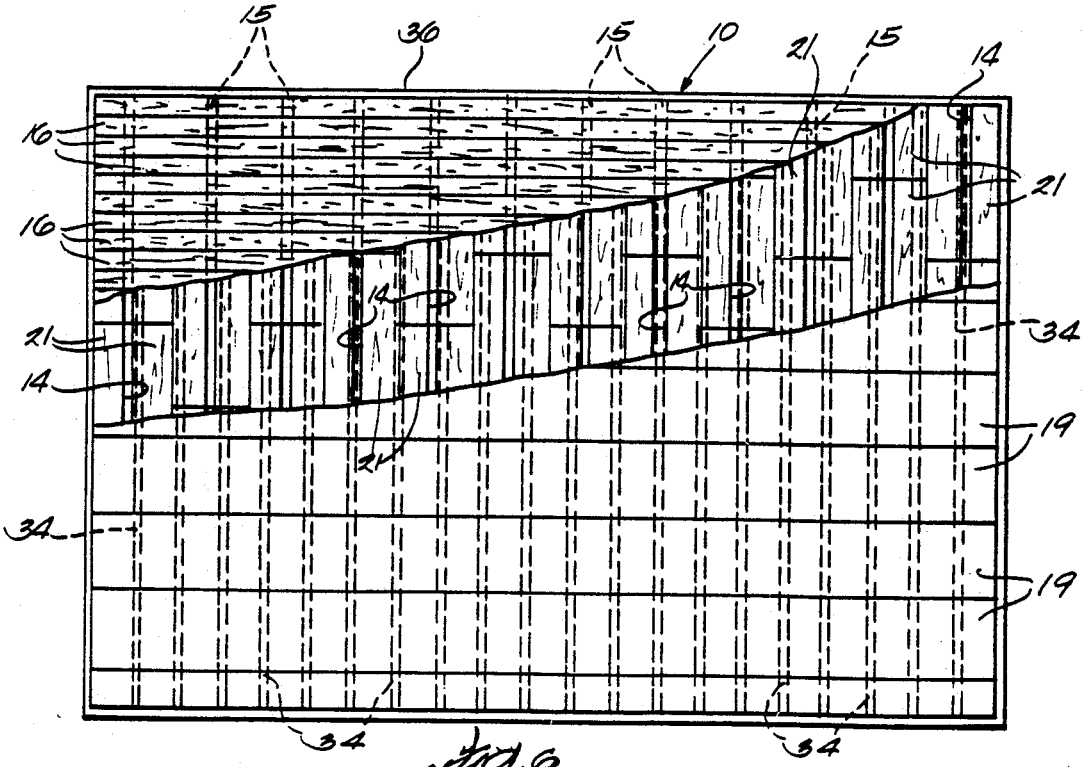
FIG. 6 is a top plan view of the flooring system shown in FIGS. 4 and 5.

The orientation and distribution of the channels 34 forming the venting means is illustrated in FIG. 6. For purposes of illustration, the flooring system 10 is shown as being installed over a substantially rectangular area although it will be appreciated that the flooring system can be installed over areas having a different shape. The foundation includes an outer peripheral edge 36 and the elongate foam strips 19, which collectively form the resilient layer 12, are disposed over the foundation 11 in substantially parallel relationship to the long dimension of the area defined by the foundation 11. Preferably, the foam strips are positioned and dimensioned such that a space or gap is maintained between the edge of the resilient layer 12 and the peripheral edge 36 of the foundation 11.

Each of the channels 34 extends substantially parallel to the short dimension of the area defined by the foundation 11, and the spacing between adjacent channels is sufficiently small so as to assure adequate ventilation over the foundation 11. By way of example, each of the channels can be approximately one inch wide, one-half inch deep, and a spacing of approximately 14" between adjacent channels can be used.

Preferably, the channels 34 are formed in the undersurface of each elongate resilient strip 19, and during installation, each strip 19 is positioned such that the channels it contains are aligned with the channels in the adjacent strips. Thus, when properly installed, the resilient layer 12 includes a plurality of channels extending substantially fully across the short dimension of the foundation 11. To assure adequate ventilation, each of the channels communicates with the atmosphere substantially at the peripheral edge 36 of the foundation 11.

Once the resilient strips having the channels 34 are installed over the foundation 11, the wood product sheets 21 are positioned over the resilient strips such that the long dimension of each sheet is substantially parallel to the short dimension of the area defined by the foundation 11 and such that a gap is maintained at the peripheral edge 36. The laminated members 15 also extend substantially parallel to the short dimension of the foundation 11, while the floorboards 16 are positioned over the wood product sheets 21 and extend substantially parallel to the long dimension of the foundation 11.

In the event moisture is present between the resilient layer 12 and the foundation 11, the channels 34 function to vent any water vapor thereby developed to the atmosphere adjacent the foundation peripheral edge 36. The accumulation of substantial moisture between the resilient layer 12 and the foundation 11 is thereby substantially avoided.

Various of the features of the invention are set forth in the following claims:

1. A flooring system comprising a layer of rigid material overlying a foundation in unsecured relation thereto and including a channel, an elongate laminated member within said channel and secured to said layer of rigid material, a floorboard overlying said layer of rigid material and said laminated member, and a fastener extending through said floorboard and into said laminated member for securing said floorboard to said layer of rigid material.

2. A flooring system in accordance with claim 1 wherein said laminated member is rigid.

3. A flooring system in accordance with claim 1 wherein said layer of rigid material includes an upper surface having said channel formed therein and wherein said laminated member defines a top surface oriented so as to be substantially coplanar with said upper surface when said laminated member is secured within said channel.

4. A flooring system in accordance with claim 3 wherein said layer of rigid material includes a plurality of said channels and wherein a plurality of said elongate laminated members are secured within respective ones of said channels.

5. A flooring system in accordance with claim 4 wherein said elongate laminated members are oriented substantially parallel to each other and are oriented substantially perpendicularly to said floor board.

6. A flooring system in accordance with claim 1 wherein said layer of rigid material comprises a plurality of individual sheets in substantially coplanar alignment with respect to one another.

7. A flooring system comprising a layer of rigid material overlying a foundation and including a channel, an elongate laminated member within said channel and secured to said layer of rigid material, said laminated member comprising a lower elongate metallic strip, an elongate strip of wood-product material disposed over said lower metallic strip and an elongate upper metallic strip disposed over said wood-product strip, a floorboard overlying said layer of rigid material and said laminated member, and a fastener extending through said floorboard and into said laminated member for securing said floorboard to said layer of rigid material.

8. A flooring system in accordance with claim 7 wherein said layer of rigid material includes an upper surface having said channel formed therein and said upper metallic strip is substantially coplanar with said upper surface when said laminated member is secured within said channel.

9. A flooring system in accordance with claim 8 wherein the thickness of said lower metallic strip is substantially greater than the thickness of said upper metallic strip and wherein the thickness of said wood product strip is substantially greater than the thickness of said lower metallic strip.

* * * * *